US006267269B1

(12) United States Patent
Kates

(10) Patent No.: US 6,267,269 B1
(45) Date of Patent: Jul. 31, 2001

(54) PORTABLE SAND DISPENSING RECEPTACLE

(76) Inventor: Steven Kates, 411 James Ave., Valparaiso, FL (US) 32580

( * ) Notice: Subject to any disclaimer, the term of this patent is extended or adjusted under 35 U.S.C. 154(b) by 0 days.

(21) Appl. No.: 09/655,293

(22) Filed: Sep. 5, 2000

(51) Int. Cl.[7] ..... B67D 5/64; B67D 3/00; B67D 5/06

(52) U.S. Cl. ..... 222/162; 222/514; 222/518

(58) Field of Search ..... 222/525, 514, 222/501, 564, 547, 175, 196, 565, 518, 500, 196.2, 162, 185.1

(56) References Cited

U.S. PATENT DOCUMENTS 2,210,206 * 8/1940 Fisher ..... 215/386
2,581,182 * 1/1952 Fields ..... 222/162
4,428,508 1/1984 Gardikas et al. .
5,105,958 4/1992 Patton .
5,484,128 1/1996 Franco, Sr. .
5,845,822 * 12/1998 Holloway ..... 222/500

* cited by examiner

*Primary Examiner*—Kevin Shaver
*Assistant Examiner*—Stephanie L. Willatt
(74) *Attorney, Agent, or Firm*—William B. Noll

(57) ABSTRACT

A portable receptacle, to be carried by a golfer, to repair and restore divot marks by dispensing sand and related granular material on the golf course. The receptacle comprises a canister housing and an axially movable, spring biased member that moves between a dispensing position and a non-dispensing position. Cooperating with the axially movable member is an internal vane member that ensures proper dispensing of the sand or sand mixture.

8 Claims, 3 Drawing Sheets

PORTABLE SAND DISPENSING RECEPTACLE

FIELD OF THE INVENTION

This invention is directed to the field of portable receptacles, more particularly to a device for dispensing a quantity of sand, such as may be carried by a golfer to repair a divot during his/her game of golf

BACKGROUND OF THE INVENTION

The present invention relates to a portable receptacle for transporting and dispensing a quantity of sand. It is not unusual during a round of golf, especially when hitting with an iron, to "take" a divot when striking the golf ball. As known in the art, a divot is a piece of turf gouged out with a golf club in making a stroke. Some golf courses, particularly at par three holes, where an iron is typically used, will place a fixed receptacle containing sand, with a hand scoop, to be used by the golfer to fill in the divot after hitting the ball. It is virtually impossible to place such receptacles at convenient positions along the fairway. As a consequence, divots in the fairway are not repaired and can become an inconvenience to golfers who follow. If ones golf ball settles into a fairway divot, it can be difficult to make a clean and accurate shot. This invention is intended to provide a golfer with a convenient tool to make divot repairs at any place on the golf course, and thereby make the game and the course more pleasant for other golfers.

A review of the prior art revealed no similar or related device to make divot repairs by the use of a portable device that may be carried by the golfer during his/her round of golf. However, the prior art does reveal portable devices that may be carried by an individual, as reflected by the following U.S. Pat. Nos.

a.) No. 5,484,128, to Franco, Sr., teaches a beverage retaining apparatus for attachment to a golf cart. The apparatus includes a beverage retaining vessel having a vessel wall, a bracket for fitting around the part, the bracket including a part encompassing member having an inner member surface and sized so that the inner member surface is larger than and spaced apart from the part outer surface. Further, included is a deformable gripping material for filling the space between the inner member surface and the part outer surface and for deforming to fit the certain shape and size of the part outer surface, and an interconnection structure for connecting the vessel to the bracket. The encompassing member preferably includes a strap member having two strap ends and being longitudinally bent end to end to form a loop configuration for encompassing the part outer surface. The interconnection structure preferably removably connects the vessel to the bracket. The interconnection structure preferably includes a channel recessed into the vessel wall having a channel open end, and a projection extending from the encompassing member and sized for sliding axial insertion into the channel through the channel open end, where the channel laterally surrounds the projection to a sufficient extent for the channel to retain the projection against lateral removal of the projection from the channel.

b.) No. 5,105,958, to Patton, relates to a water bottle and support assembly for a golf bag, and includes a retainer bracket, a hanger strap and retaining belt for mounting the retainer bracket on the golf bag, and a water bottle supported by the bracket. The retainer bracket has a front surface provided with a vertically extending dovetail groove, and the water bottle has a corresponding dovetail tongue thereon sized to fit within the groove, so that the bottle can be easily and quickly installed or removed.

c.) No. 4,428,508, to Gardikas et al., is directed to an elongated container for drinking water to be used by athletes where the container is formed from a resilient laterally deformable polymerized resin. The container has a wide mouth neck that has first coarse threads on the exterior thereof that are threadably and frictionally engaged by second coarse threads on the interior of the combined closure and drinking water dispensing assembly. The assembly has a water dispensing tube projecting outwardly therefrom through which a jet of drinking water is discharged when the container is squeezed by an athlete. The assembly rotatably supports an inverted cup shaped guard, which guard is free to rotate thereon. Visual insignia are provided on the guard to axially align first and second pairs of openings in the closure and guard to permit an elongate rigid member to be extended therethrough, and used to twist the closure assembly into binding frictional engagement with the neck. The elongate member when removed from the openings allows the guard to rotate freely on the closure. Rotation of the guard by an athlete will have no effect on loosening the combined closure and water dispensing assembly from the container to allow the athletes to drink directly from the neck of the container which is unsanitary.

While these prior art devices offer aids to golfers and other athletes, such as a device for carrying water, none present a device for containing and dispensing sand on a divot mark on the golf course. The manner by which the present invention achieves these goals will become more apparent in the description to follow.

SUMMARY OF THE INVENTION

This invention is directed to a golfer aid, more particularly a portable receptacle for dispensing a quantity of sand or related granular products onto a divot, for example. The receptacle comprises a first generally cylindrical canister body of a first diameter having a first open end receiving a hinged cap, and a second open end having a reduced diametric section and a flared end having a peripheral edge, where the flared end has a diameter greater than the reduced diameter. Overriding the second open end, and in sliding engagement therewith, is a second generally cylindrical housing body. Further, a circular vane member is disposed for axial movement within the cylindrical canister body, and a compression spring disposed within the housing body for biasing the vane member. A normal, manual pressure on the housing body effects a compression on the spring which inturns axially raises the vane member allowing the sand to exit the canister body and pass through the housing body.

Accordingly, an object of the invention is to provide a golfer with a convenient device for filling a divot on a golf course.

Another object hereof is the provision of a sand dispensing device that controls the quantity of sand that may be dispensed at a selected time.

A further object of the invention ties in the use of a spring biased vane member to control the dispensing of sand.

These and other objects will become clearer from the description which follows, particularly to those skilled in the art when read in conjunction with the accompanying drawings.

DETAILED DESCRIPTION OF PREFERRED EMBODIMENT

Figure 1:
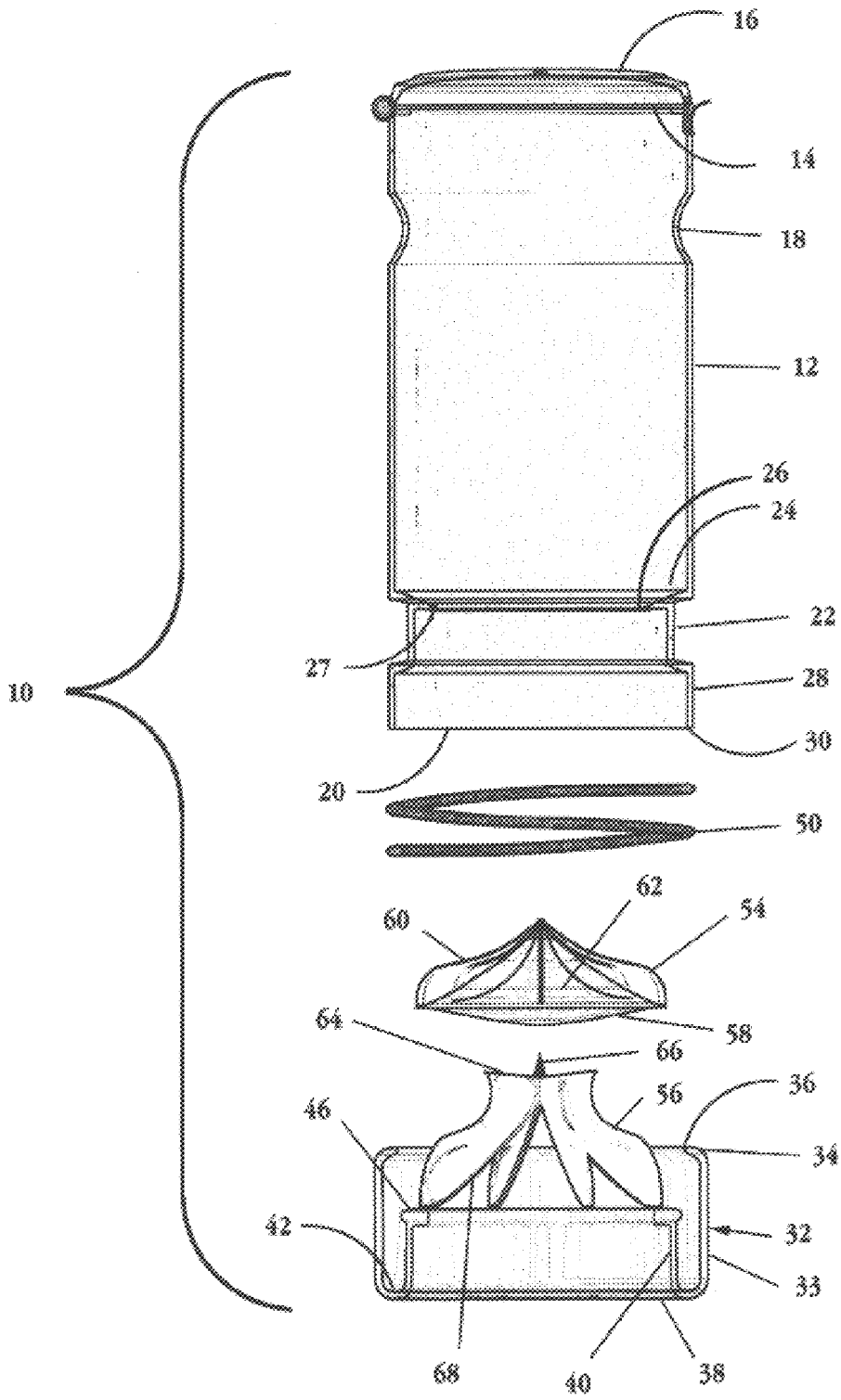
FIG. 1 is an exploded, partial sectional view of the portable sand dispensing receptacle according to this invention.

This invention relates to a portable receptacle for dispensing sand, such as may be used by a golfer in filling divots. The device hereof will now be described with regard to the accompanying drawings, where like reference numerals represent like components or features throughout the several views.

Turning now to FIG. 1, showing an exploded sectional view of the receptacle 10 of this invention, the receptacle 10 comprises a generally cylindrical canister body 12, of an essentially uniform diameter, which features an open top end 14 and mounts a hinged and latchable cover 16 to allow easy filling of the receptacle with sand, or related granular material. In close proximity to the top end 14, an optional recessed, annular portion 18 may be provided to facilitate handling and dispensing of the sand, as later described.

The opposite end 20 of the canister body 12 includes a reduced diametrical, concentric section 22, where its junction with the canister body 12 features a tapered wall 24 and an inwardly directed, annular flange 26, such that the opening 27 defined by the annular flange 26 is less than the diameter of the concentric section 22. A final feature of the opposite end 20 is the concentric, outwardly and downwardly directed flared portion 28, where the flared portion terminates in a peripheral annular rim 30.

Figure 2:
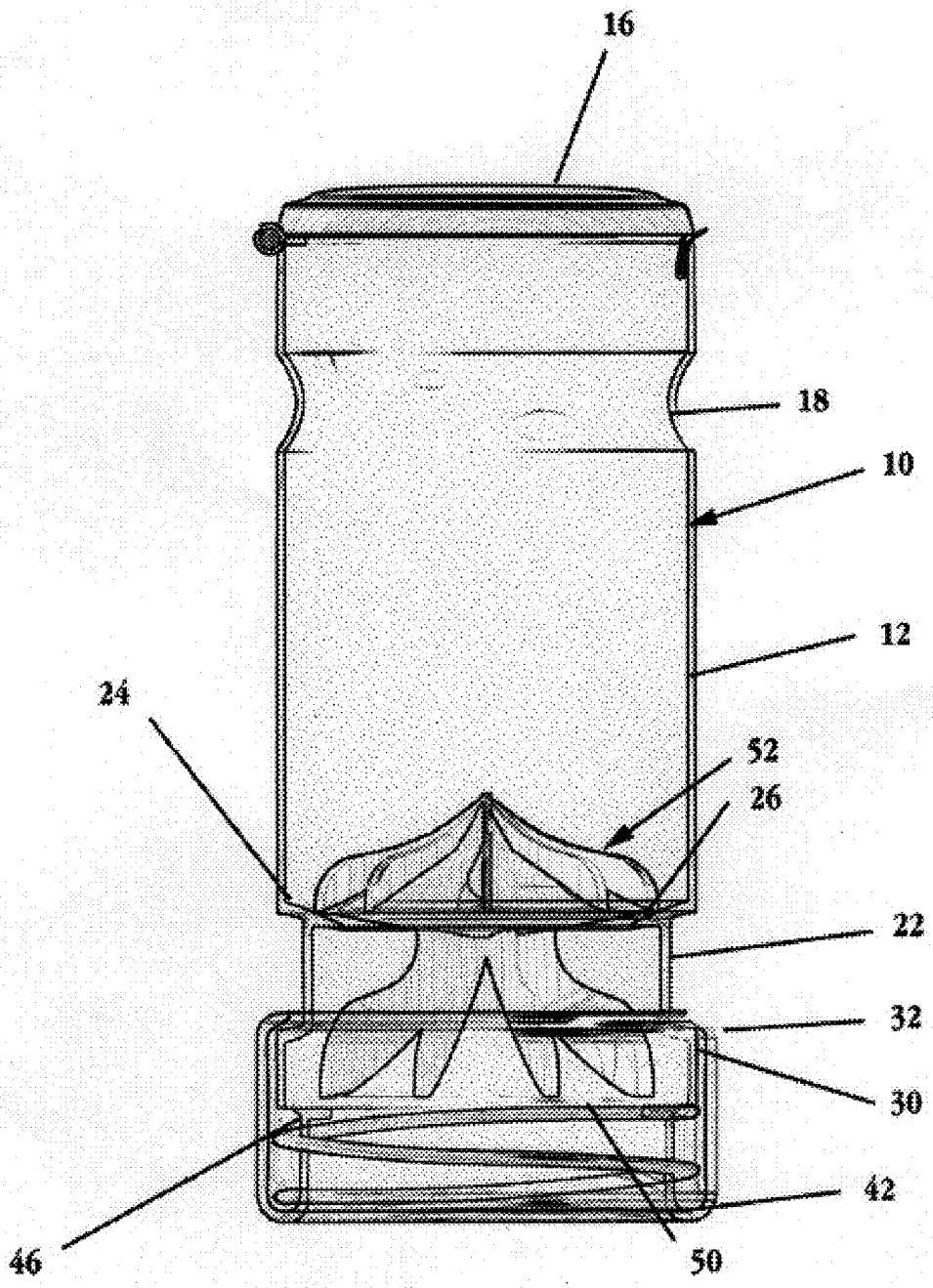
FIG. 2 is an assembled, partial sectional view of the portable sand dispensing receptacle of FIG. 1, showing the receptacle in the non-dispensing mode.
Figure 3:
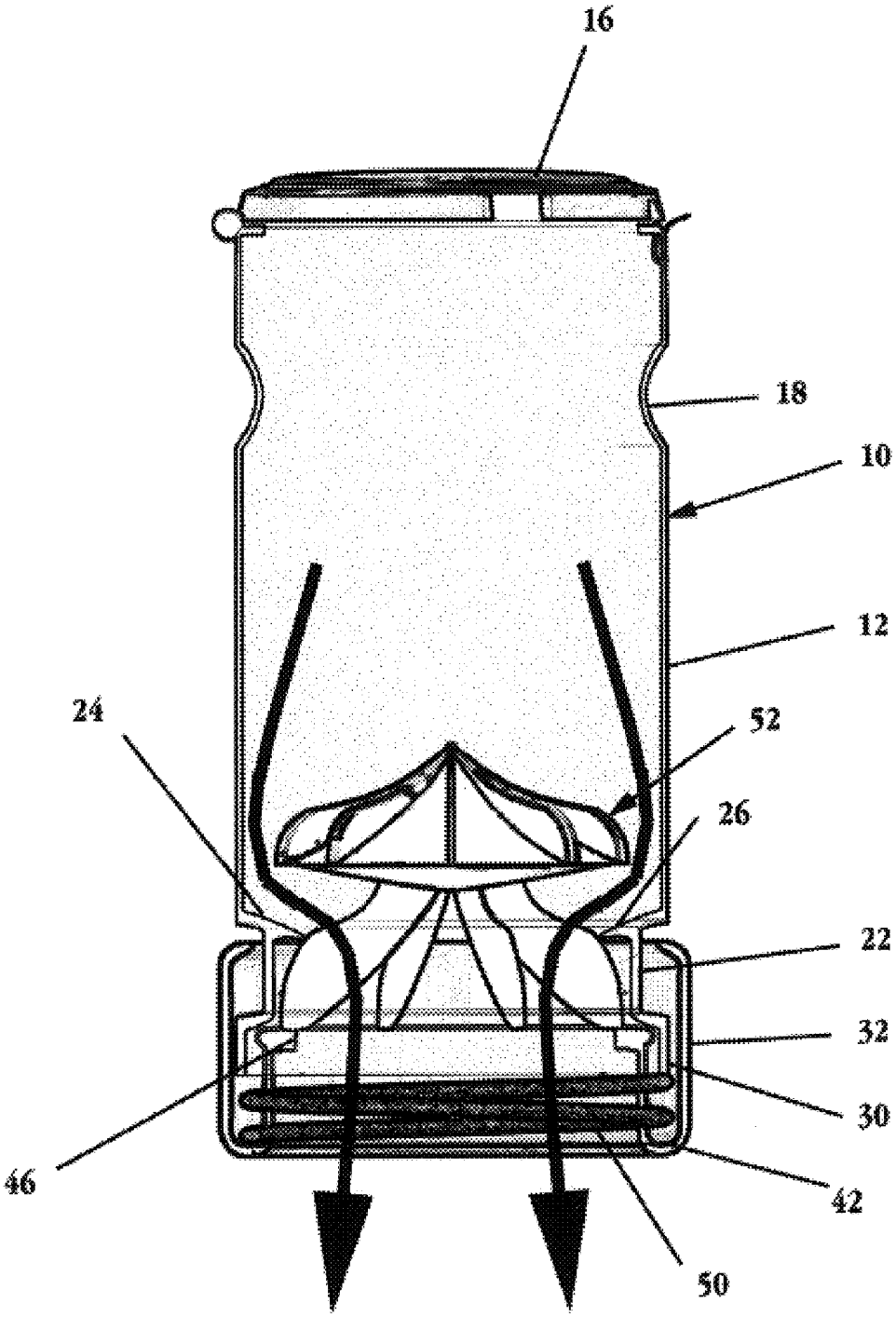
FIG. 3 is an assembled, partial sectional view similar to FIG. 2, showing the receptacle in the sand dispensing mode.

Cooperating with the canister body 12 is a cylindrical housing member 32 having a wall 33 and sized to override the opposite end 20 and slidably engage said reduced diametrical, concentric section 22, see further FIGS. 2 and 3. The top end 34 is open but features an inturned edge 36 to ensure that it is retained on the canister body 12 at the concentric section 22. The opposite end 38 of the housing member 32 includes an inturned and upwardly extending wall 40 that is concentric with and spaced from wall 33 to define an annular channel 42. The free end 44 of the inturned wall 40 may be provided with an annular, preferably flat rim 46.

Internally, the receptacle 10 of this invention includes a compression spring 50 sized to be slidably received within the annular channel 42. Cooperating with the compression spring 50 is a circular vane member 52, preferably composed of an upper member 54 and a lower member 56. The upper member 54 is essentially cone shaped having a base 58 and plural radial vanes 60 projecting outwardly from the surface 62. The respective radial vanes help to break up any sand which may be wet and caking. Though not shown, the base includes a central aperture for snap engaging the lower member 56, as later described. Such lower member 56 comprises a base 64 having a central projection 66 for snap engagement with the upper member 54, as noted above. Since the base 58 is greater than the opening 27, the assembled vane member 52 will seat on the annular flange 26, see FIG. 2. Further, by the provision of plural downwardly and outwardly extending, radial vane 68, the vane member 52 will be limited in its upward movement, see FIG. 3. Further, note that the ends 70 of the radial vanes 68 rest on the flat rim 46, the function of which will become clearer in the further description of FIGS. 2 and 3.

FIGS. 2 and 3 illustrate the assembled receptacle 10 of FIG. 1, and show respectively the non-dispensing mode with the spring 50 in a resiled position, and the dispensing mode with the spring 50 in a compressed position. As noted in FIG. 2 the upper vane member 54 is seated on the tapered wall 24 and annular flange 26 to prevent any flow of sand or granular products from discharging from the canister body 12. To operate, with the user's fingers preferably gripping the receptacle at recessed, annular portion 18, the receptacle 10, overriding and in contact with a divot to be repaired, is pushed against the divot area, not shown. As best seen in FIG. 3, the cylindrical housing member 32 is pushed axially upwardly with the spring in contact with annular rim 30, thus freeing the vane member 52 from contact with the tapered wall 24 and annular flange 26. Note the directional flow arrows showing the path for releasing the sand or other granular material from the canister onto the divot area. Upon releasing the receptacle, the stored energy of the spring 50 will return the cylindrical housing member 32 to its position shown in FIG. 2 and prevent the further flow of sand, etc. therefrom. The receptacle hereof, by its ability to incorporate seed and grass feed into a sand mixture, can be a source to environmentally repair and restore a golf course to a prime playing condition.

It is recognized that changes, variations and modifications, particularly by those skilled in the art, made be made to the receptacle of this invention, such as a convenient mounting means to secure the receptacle to one's golf bag or golf cart. Accordingly, no limitation is intended to be imposed thereon except as set forth in the following claims.

What is claimed is:

1. A portable receptacle for dispensing a quantity of sand or related granular products, the receptacle comprising;

a.) a first generally cylindrical canister body of a first diameter having a first open end receiving a hinged cap, and a second open end having a reduced diametric section and a flared end having a peripheral edge, where the flared end has a diameter greater than said reduced diameter;

b.) a second generally cylindrical housing body of a size for axial sliding receipt on and about said second end; and, c.) a circular vane member disposed for axial movement within said cylindrical canister body, and a compression spring disposed within said housing body for biasing said vane member, where a manual pressure on said housing body effects a compression on said spring which inturn axially raises said vane member allowing said sand or related granular products to exit said canister body and pass through said housing body.

2. The portable receptacle according to claim 1, wherein said housing body includes a side wall having a first end with an inturned wall portion concentric with said side wall, where said side wall and said wall portion define an annular channel for receiving said compression spring.

3. The portable receptacle according to claim 2, wherein said housing body further includes a second end having an inturned peripheral edge, where said peripheral edge is adapted to slidably move along said reduced diametric section.

4. The portable receptacle according to claim 3, wherein the peripheral edge of said flared end acts against said compression spring in the compression and dispensing mode.

5. The portable receptacle according to claim 1, wherein said canister body internally includes an inwardly directed annual flange at the junction defining said first diameter and said reduced diametric section, where said annual flange defines a diametric opening less than said reduced diametric section for seating said circular vane member in the non-compression and non-dispensing mode.

6. The portable receptacle according to claim 1, wherein said circular vane member comprises at least a pair of interconnecting members, each said connecting member having a diameter greater than said diametric opening of said annular flange.

7. The portable receptacle according to claim 6, where one of said interconnecting members projects upwardly into said canister body and is essentially cone shaped with plural radial vanes about the surface thereof.

8. The portable receptacle according to claim 7, where the second said interconnecting member comprises an essentially circular base having plural radial vanes extending downwardly therefrom.

* * * * *